US005462119A

United States Patent [19]

de Souza et al.

[11] Patent Number: 5,462,119

[45] Date of Patent: Oct. 31, 1995

[54] TUBING HANGING SET FOR A SUBMARINE OIL-WELL, RUNNING TOOL FOR ITS PLACING AND HANDLING METHOD

[75] Inventors: Walber P. de Souza, São Goncalo; José R. F. Moreira, Rio de Janeiro, both of Brazil

[73] Assignee: Petroleo Brasileiro S.A.-Petrobras, Rio de Janeiro, Brazil

[21] Appl. No.: 242,625

[22] Filed: May 13, 1994

[51] Int. Cl.[6] ..... E21B 33/043; E21B 33/047

[52] U.S. Cl. ..... 166/348; 166/97.5; 166/208; 166/382

[58] Field of Search ..... 166/382, 313, 166/348, 208, 85, 97.5

[56] References Cited

U.S. PATENT DOCUMENTS

| | | | |
|---|---|---|---|
| 3,693,714 | 9/1972 | Bangh | 166/85 X |
| 3,800,869 | 4/1974 | Herd et al. | 166/382 X |
| 4,098,335 | 7/1978 | Goad | 166/120 |
| 4,262,748 | 4/1981 | Kirkland | 166/348 |
| 4,474,236 | 10/1984 | Kellett | 166/382 X |
| 4,736,799 | 4/1988 | Ahlstone | 166/348 |

*Primary Examiner*—Hoang C. Dang

*Attorney, Agent, or Firm*—Sughrue, Mion, Zinn, Macpeak & Seas

[57] ABSTRACT

A tubing hanging set for hanging, locking and sealing a submarine oil well includes a tubing hanger which is seated on an upper internal surface of a connection sleeve which in turn is seated on an internal surface of a casing hanger. The tubing hanger is provided with passageways extending therethrough and tubular extensions are connected in the passageways and to tubing passing through a double hydraulic packer. The lower end of one of the tubes passing through the packer extends into a oil producing zone and the other tube passing through the packer is in communication with an annular chamber between the other tubing and the casing. An installation tool is also provided which can be detachably connected to the tubing hanger for carrying out a method of installation of the tubing hanging set in a wellhead housing.

3 Claims, 4 Drawing Sheets

TUBING HANGING SET FOR A SUBMARINE OIL-WELL, RUNNING TOOL FOR ITS PLACING AND HANDLING METHOD

BACKGROUND OF INVENTION

The present invention refers to an equipment assembly meant to promote the hanging, locking and sealing of a submarine oil-well tubing.

It is the scope of the present invention to provide a set of pieces of equipment for the support, locking and sealing of the tubing of a submarine oil-well, the two last functions being performed by a double hydraulic packer (for production), besides establishing a method for the use of the referred set.

To make the oil produced by an oil-well flow it is necessary to perform several operations from the beginning of the drilling until its effective production. Several pipings are installed in the well, by operations the experts call pipe running (in-hole running).

These pipes carry out the lining of the well, in this case called "casing", or serve to lead the oil to the set of equipments existing on the sea bed, where the wellhead and the Christmas-tree are located.

Simply speaking, the purpose of the wellhead is to support the load of the several hangers where the well casing and the production tubing are fixed on and also provides means of sealing the well to prevent leaks, and also as a support for the set of valves, seals and control devices that enable the connection of the well with the piping which takes the oil to the storage- or processing place. This last set is called Christmas-tree by the specialists. In the case of submarine producing oil-wells the experts denominate these sets as "Submarine wellhead" and "Wet Christmas-tree".

The operations of preparing an oil-well for production are called "completion" by the technical people. Among the completion operations one is highlighted for presenting a large amount of failures, causing large losses to the operations, which is the placing of the tubing hanger. The tubing hanger basically has the functions of supporting the tubing, to lock the tubing against axial movements and, finally, to provide the sealing at the casing hanger where it is sustained.

The large amount of failures on the tubing hangers is due to their locking and their sealing being performed by elements with relatively small dimensions as compared to the size of the referred tubing hanger which makes this latter easily subjected to damages. This is worsened by the fact that very often debris from the sea bed settle on the surface of the casing hanger, where the tubing hanger will be supported in order to be locked and sealed, making the success of these operations more difficult. The settlement of debris is unavoidable because it results from the turbulence caused by placing the pieces of equipment on the wellhead, which stirs the debris in the vicinity of the well.

Another factor to be taken into consideration is the complexity of the tubing hanger hydraulic running tool, which needs for its operation the use of a complex piece of equipment the specialists call "completion riser". The hydraulic running tool will need up to four hydraulic functions to place the tubing hanger, which means a piece of equipment of difficult maintenance due to its high number of components.

The above-mentioned problems cause large loss of time and, as a consequence, rising of costs due to the high number of steps needed to perform the operation of placing the tubing hanger, not mentioning the cost of unforeseen extra operations to correct failures that may occur.

It is clearly seen that the current art, besides not providing the needed safety for the tubing hanger placing operation, frequently leads to an increase in the final costs of the operations due to the necessity of not scheduled operations for correction of problems.

SUMMARY OF THE INVENTION

It is the scope of the present invention to provide an equipment set to support the tubing of a submarine oil-well; also provide a method for its use, in order to eliminate the necessity of locking and sealing the tubing hanger on its seat on the casing hanger.

The tubing hanger seats on a sleeve that seats itself on the casing hanger. The locking and sealing is done by a double hydraulic packer seated on the casing, slightly below the wellhead.

BRIEF DESCRIPTION OF THE DRAWINGS

The present invention will be described based on the drawings attached to it, as follows.

DETAILED DESCRIPTION OF THE INVENTION

Figure 1:
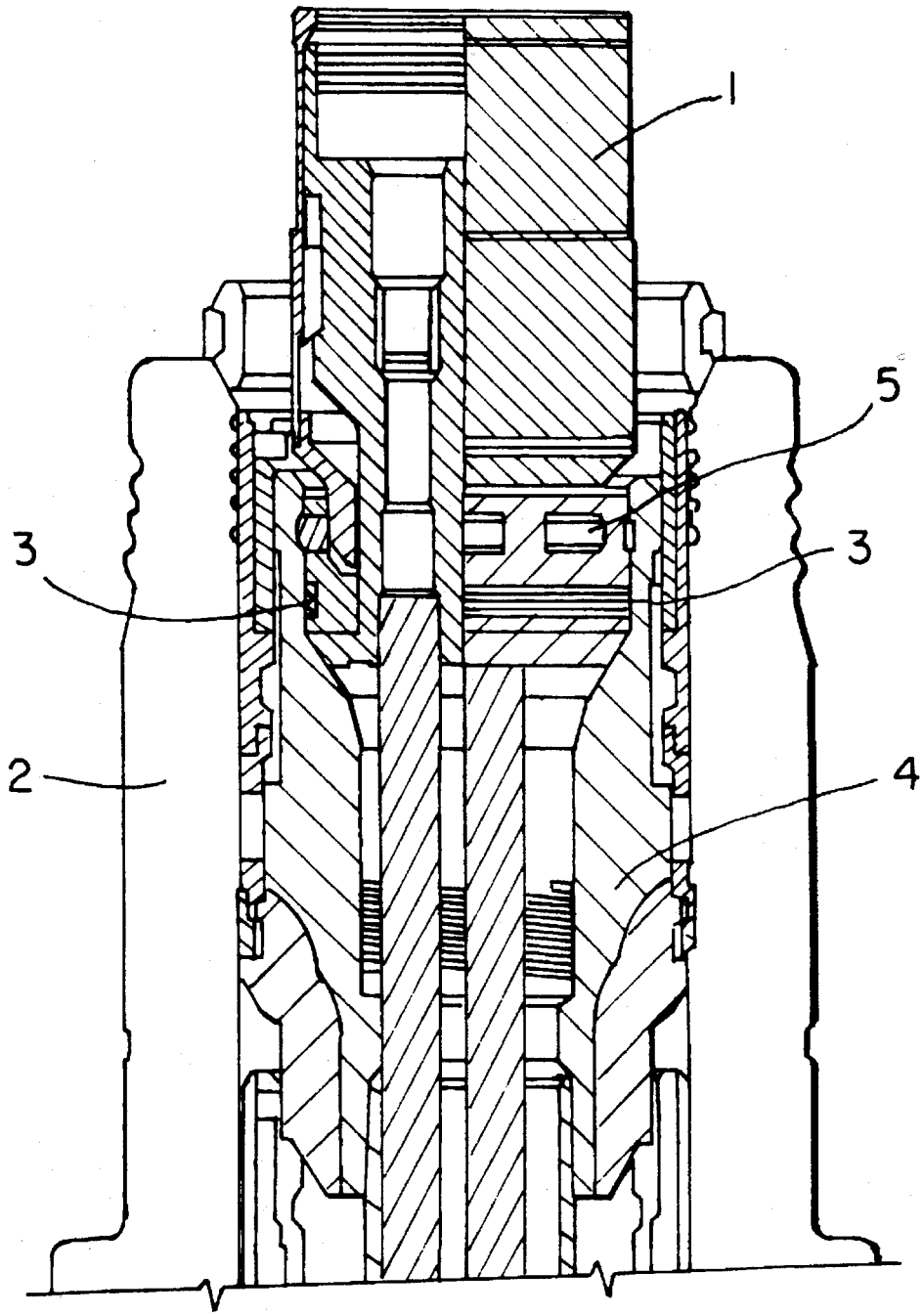
FIG. 1 PRIOR ART
FIG. 1 shows a frontal view of a cross section of a tubing hanger according to the prior art, already seated on the casing hanger.

Before the beginning of the description of the invention, reference is made to FIG. 1, where the tubing hanger 1 can be seen, designed in accordance with the prior art, seated on the casing hanger 4, this one now seated on the wellhead housing 2.

The tubing hanger 1 is supported and locked on the casing hanger 4 by means of grips 5, in order to prevent axial movements of the tubing, and the sealing between the two parts is done by a packing unit 3.

As can easily be seen in FIG. 1, either the packing unit 3 or the locking grips have rather reduced dimensions, if compared to the size of the tubing hanger 1. As no other points for locking and sealing exist than the referred, one concludes that locking and sealing of the tubing hanger 1 are precarious. A slight fault on the alignment or the presence of debris on the surface of the casing hanger 4 where the tubing hanger is seated is enough to endanger the operation, worsened by the inherent difficulties of an operation performed remotely from the surface.

Figure 2:
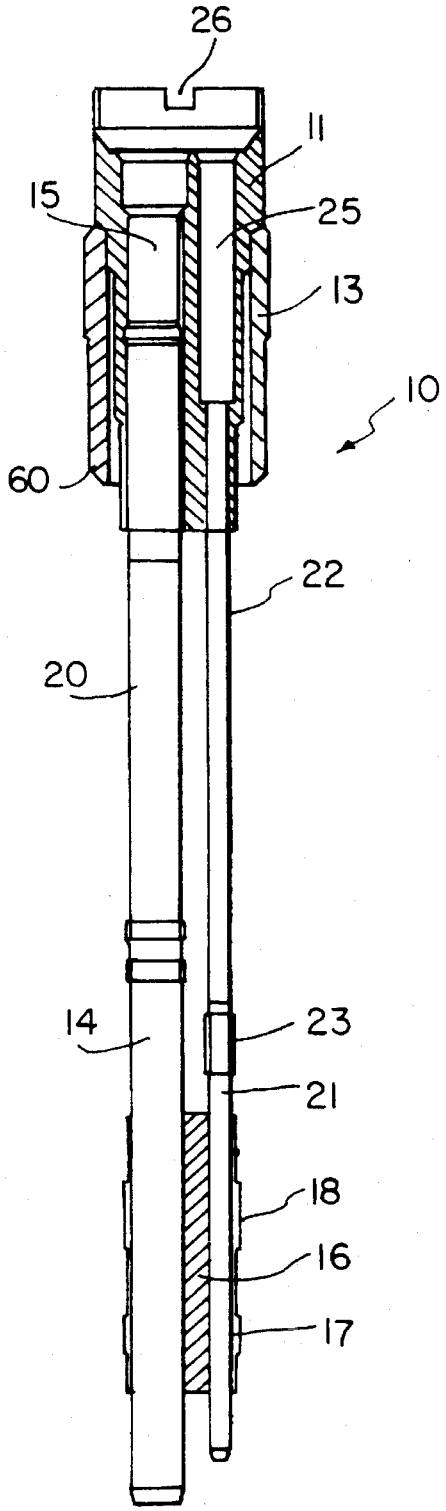
FIG. 2 shows a cross section of a tubing hanger used in the present invention and the double hydraulic packer used for locking and sealing the tubing.
Figure 3:
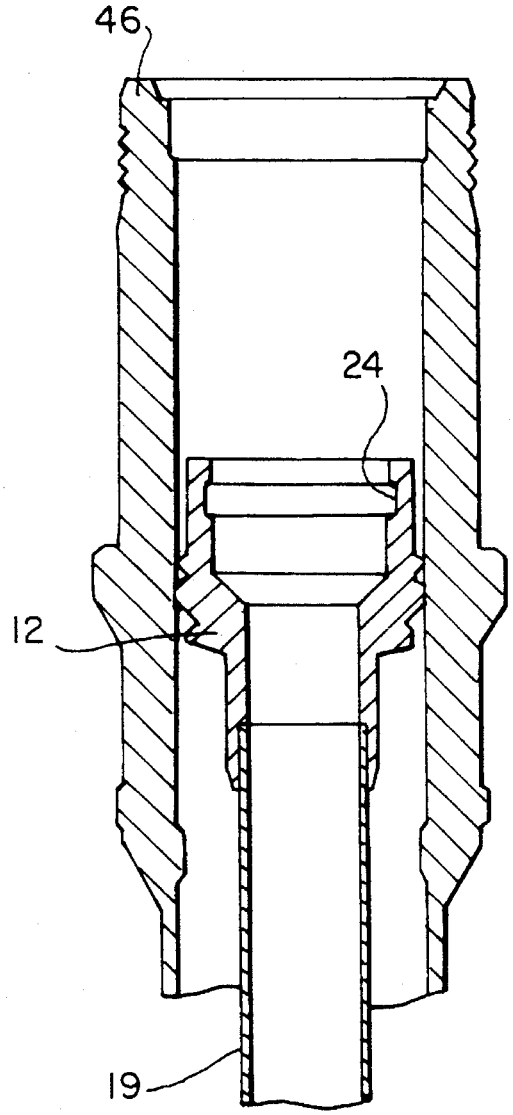
FIG. 3 shows a cross section of a wellhead with the casing hanger already placed.

In FIG. 2 a set of pieces of equipment 10 can be seen which shall be denominated tubing hanging set according to the concept of the present invention. The referred tubing hanging set 10 basically consists of a tubing hanger 11, tubular extensions 20 and 22 and a double hydraulic packer 16.

Figure 4:
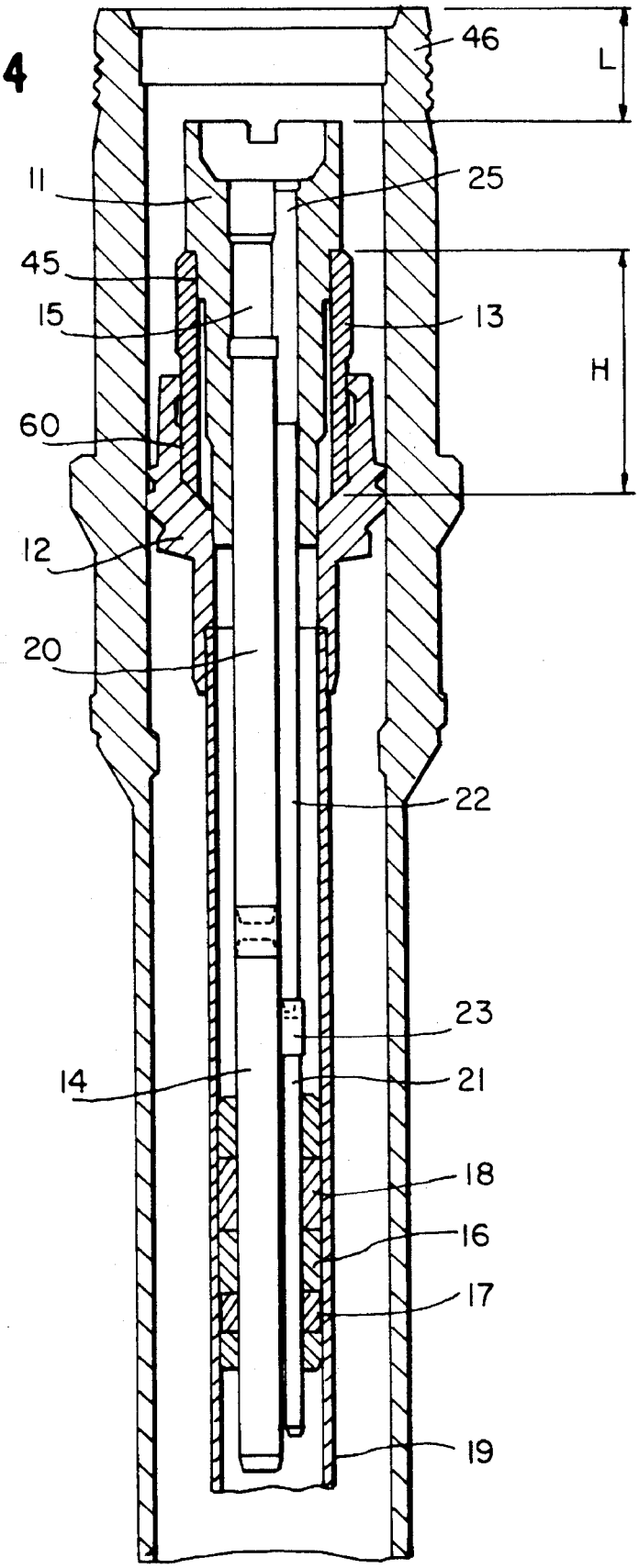
FIG. 4 shows a frontal elevation of the tubing hanger already placed according to the method of the present invention.

The tubing hanger 11, opposed to the previous technique, is simply seated on the upper internal portion of a connecting sleeve 13. The lower external portion 60 of the connecting sleeve 13 on its turn seats on the upper internal part of the casing hanger 12, as seen in FIG. 4. It is important to point out that this casing hanger 12 is of the same type as those used by the prior art and does not need any change for utilization of the tubing hanging set 10, which is the subject of the present invention.

The locking and fixing of the tubing hanging set 10 is done by the grips 17 of the double hydraulic packer 16, and the sealing of the tubing hanging set 10 by means of the packing unit 18 of the double hydraulic packer 16. On FIG. 4 the tubing hanging set 10 duly seated can be better seen.

As the position of the casing hanger 12 regarding the top of the high pressure wellhead housing 46 varies according to the manufacturer, the connecting sleeve 13 must have its dimension "H" designed properly to ensure that the top of the tubing 11 keeps a certain distance "L" in respect to the top of the high pressure wellhead housing 46, suitable for installation of the wet Christmas-tree which will afterwards be installed on this high pressure wellhead housing 46.

It can be well seen that the connection sleeve 13 is one of the main features of the present invention, simultaneously playing two roles since besides promoting the connection between tubing hanger 11 and casing hanger 12, it makes possible to set easily the position the top of the tubing hanger 11 in respect to the high pressure wellhead housing 46 top. It is sufficient for this purpose that the connecting sleeve 13 have its dimensions designed so as to ensure that the final assembly of the set will be done as desired, viz., that for each high pressure wellhead housing 46 supporting any casing hanger 12 it will be always possible to seat the top of the tubing hanger 11 as required by the Christmas-tree to be installed. The only requirement is that connecting sleeve 13 have its dimensions properly established.

The tubing hanger 11 has a passageway 15 for connection with the extension 20, which in turn is connected to the tubing 14 and a passageway 25, having inside thereof a valve for blocking the flow coming from the annulus between the tubing 14 and the casing 19 below the double hydraulic packer. The juncture from passageway 25 to the referred annulus is expected by the extension 22, which is connected by means of the sleeve 23 to the short tubing 21 of the double hydraulic packer 16, as shown on FIGS. 2 and 4.

The tubing hanger 11 has also passageways for hydraulic lines, not shown in the drawings, which lead to the subsurface safety valve, added to other technical details needed for the operations which are also found in the hangers designed according to the prior art and not mentioned in this report, since they are largely known by the specialists and do not pertain to the scope of the present invention, although they have to be considered at time of design and fabrication.

As already mentioned, the double hydraulic packer 16 is one responsible one for locking and sealing of the tubing hanging set 10 and, for this purpose is provided with grips 17 for locking and at least one sealing unit 18. The double hydraulic packer is a well known equipment, used, for instance, for completion of wells in multi-production zones. In the present invention, as already seen, it is used in a different function.

Figure 5:
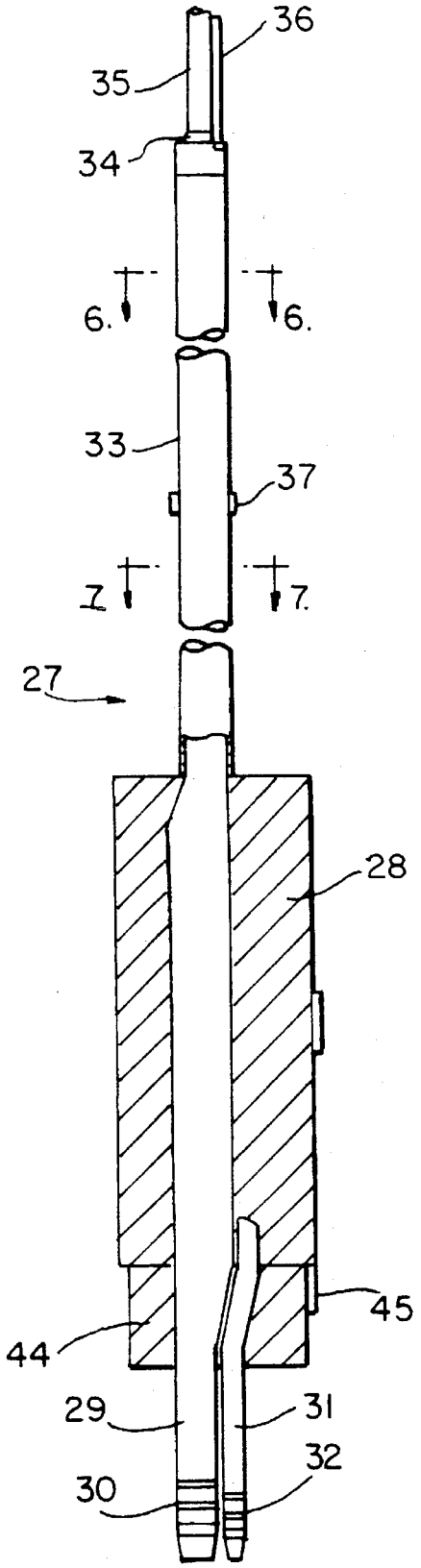
FIG. 5 shows an elevation with partial cross section of the running tool of the tubing hanger.

The placement of the tubing hanging set 10, object of the present invention, is done by means of a tool 27, shown in FIG. 5, and which is a feature of the present invention.

The tool 27 comprises a lengthened body with an enlarged part 28 of cylindrical shape, usually called re-entry mandrel by the skilled in the art. As shown in FIG. 5, the eccentricily of the tubular elements that make up the tool 27 are located in the re-entry mandrel 28.

Below the re-entry mandrel 28 there are two tubular elements 29 and 31 used for direct connection with the tubing hanger 11. The tubular connection elements 29 and 31 are provided at their lower ends with coupling terminals 30 and 32, respectively, which are provided with elastomeric sealing rings confined inside suitable grooves.

Such coupling terminals, as will be explained in detail together with the operation description, fit into passageways 15 and 25 on tubing hanger 11, their upper parts entering in such a way that this coupling remains secure and lead tight.

The tubular extension 33 above the re-entry mandrel 28 is a cylindrical pipe vertically aligned which has on its upper end a connector 34 for connection to the lowering string for the tool 27. Also, the connector 34 is provided with fittings for connection of hydraulic lines 36 for installation and operation control.

Figure 6:
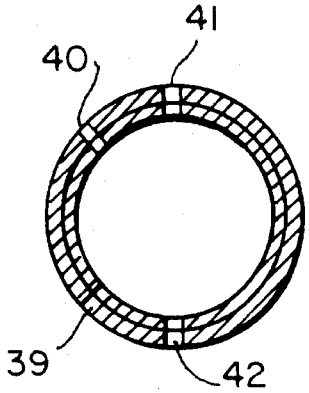
FIG. 6 shows a cross section of the tool take along the 6—6 of FIG. 5.
Figure 7:
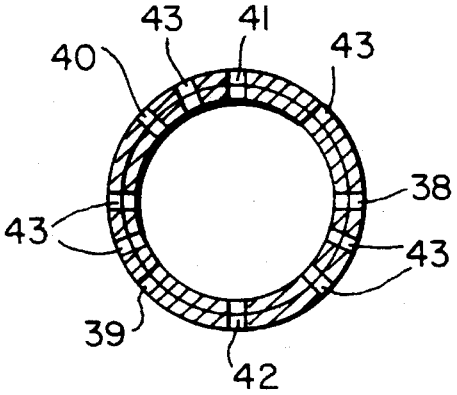
FIG. 7 shows another cross section of the tool take along the line 7—7 in FIG. 5.

The tubular extension 33 is a hollow cylinder with a certain wall thickness. As shown in FIGS. 6 and 7, several longitudinal borings are made in its wall for passageways of the hydraulic control lines. Thus, FIG. 5 shows that on the upper tubular extension 33, at an intermediate height, there are holes provided with filters 37 which allow the communication between the inside of the tool and the external region.

FIGS. 6 and 7 disclose sections made at two levels of the hollow tubular extension 33 (section 6—6 and section 7—7) to show these holes which are, for example, holes 40 and 41 defining passageways for subsurface safety valve control and operation lines, the tubular holes 38 and 39 meant for the passageway of the locking and unlocking control pipes for the connections to be made. The holes 43 are meant for lines that give access to the annulus in the casing 19.

Before continuing the description steps, it have to be clear that the quantity and disposal of the different passageway holes for remote control and operation lines are given only to exemplify the possibility of their use in the present invention, not and the invention is in any way limited because of them. Furthermore it is necessary to add that none of the locations or quantities of elements is final, being only representative of one real possibility.

On the lower part of the tubing hanger installation tool 27, can be seen an extension 44 which is dimensioned to its introduction into the upper part of the tubing hanger 11 and has a cam 45, that fits into the notch 26 on the top of the tubing hanger 11 when coupling tool 27 to tubing hanger 11, enabling torque to be applied for orientation of the tubing hanger 11.

Another characteristic of the tool 27 is the fact that its tubular extension 33 may be sheared by a special shear valve, of the submarine blow out preventor, in case of any emergency.

A large advantage that is presented by the present invention is the fact that the running string 35 of the tool 27 is nothing else than the proper drilling string, viz. that tool 27 replaces a complex equipment called "completion risers", which are used on tubing hangers for placing operations designed according to the prior art.

The method for installing the tubing hanging set 10 consists in, before running the assembly, coupling the bottom part of tool 27 to the tubing hanger and locking this bottom part of tool 27 by pressing its extension element 44 against the top of the tubing hanger 11, fitting its cam 45 into the notch 26 existing on the top of tubing hanger 11, so as the assembly can rotate to couple in an exact positioning.

At this point, the tubular connection elements 29 and 31 shall be duly fitted in the passageways 15 and 25 of the tubing hanger 11 and properly sealed by means of the sealing rings of the fitting terminals 30 and 32, respectively.

The double hydraulic packer 16 will be run coupled to the bottom part of the tubing 14, and connected at the upper part to the tubular extensions 20 and 22, that connect to passageways 15 and 25 respectively.

The assembly described above, together with the hydraulic lines and necessary cables already connected via connector 34, runs to the wellhead housing 46 where it is inserted until the tubing hanger 11 seats on the connecting sleeve 13, which was previously seated on the casing hanger 12.

The double hydraulic packer 16 is then hydraulically fixed by means of pressure applied on tubing 14, promoting in this way sealing and locking of the whole assembly in a more safety way than the manner of the prior art.

Thus, functionally speaking, the tubing hanging set 10, of the present invention, comprises all components from the tubing hanger 11 to the double hydraulic packer 16, leaving to the tubing hanger 11 only the function of supporting the tubing weight, while the double hydraulic packer 16 responds for locking and sealing the assembly.

Once more it must be clear that the described devices are presented in a general manner and the construction details should not in any way must be considered as restricting the invention, since they serve only to give notice to the skilled in the art how the different parts are combined to achieve the desired result.

The installation tool for the assembly, which is also a feature of the present invention, may not be limited by specific construction details, but considered as a whole assembly and as a conception of practical use. Incidental modifications should be considered as included in the scope of present disclosure and its basic concept and with the scope of the claim.

We claim:

1. A tubing hanging set for hanging, locking and sealing a submarine oil-well comprising a tubing hanger (11), a connection sleeve (13), a double hydraulic packer (16) and tubular extensions, (20) and (22), wherein the tubing hanger (11) is seated on an upper internal part (45) of said connection sleeve (13), said connection sleeve (13) having a lower external part seated on an internal upper part (24) of a casing hanger (12); said tubing hanger (11) having passageways (15) and (25) extending therethrough; one of said passageways (15) being connected with one of the tubular extensions which in turn is connected to tubing (14) extending through said double hydraulic packer (16) and the other of said passageways (25) having internally a valve to block the flow from the annulus between tubing (14) and casing (19) located in the portion below the double hydraulic packer (16); the connection from the other of said passageways (25) and said annulus being made by the other of said tubular extensions (22) connected by means of a sleeve (23) to a short tubing (21) extending through the double hydraulic packer (16); said double hydraulic packer (16) having grips (17) for locking tubing hanging set (10) and at least one packing unit (18) for sealing said tubing hanging set (10) in a casing depending from said casing hanger.

2. A tubing hanging set as set forth in claim 1 further comprising installation means for installing said tubing hanging set including a re-entry mandrel (28) of cylindrical shape, a lower extension (44) provided with a cam (45), tubular elements (29) and (31) extending through and below said mandrel and lower extension with coupling terminals (30) and (32) thereon detachably connected to said passageways, an upper hollow cylinder extension (33), connector means for connection to a running string (35) and a connector (34) for connecting hydraulic lines.

3. A method for installation of a tubing hanging set (10) as set forth in claim 1 further comprising connecting and locking a running tool (27) on said tubing hanger (11) by pressing an extension element (44) of the running tool (27) into a recess on top of said tubing hanger (11) and fitting a cam (45) on the running tool (27) into a notch (26) in the recess of said tubing hanger (11), rotating the tubing hanging set for correct placing; fitting tubular connection elements (29) and (31) on the running tool into said passageways (15) and (25) of said tubing hanger (11) and sealing the connection elements by sealing rings on connection terminals (30) and (32) at lower ends of the connection elements; fitting a lower part of the passageway (15) of said tubing hanger (11) to one of the tubular extensions (20) which is connected to the tubing 14, which passes through the double hydraulic packer (16), said tubing (14) extending into an oil producing zone; fitting a lower part of the passageway (25) of said tubing hanger (11) to the other of said tubular extensions (22), which is connected to the short tubing (21) of the double hydraulic packer (16) by means of a sleeve (23); running the tubing hanging set (10) by means of a drilling string (35) into a wellhead housing (46) until the tubing hanger (11) seats on the connection sleeve (13), previously seated on casing hanger (12) in the wellhead housing; fixing double hydraulic packer (16) by applying pressure on said tubing (14) to accomplish locking and sealing of the tubing hanging set (10).

* * * * *